US009827154B2

(12) United States Patent
Møller et al.

(10) Patent No.: US 9,827,154 B2
(45) Date of Patent: Nov. 28, 2017

(54) SEAT

(71) Applicant: R82 A/S, Gedved (DK)

(72) Inventors: Flemming Møller, Horsens (DK); Knud Jørgensen, Odder (DK)

(73) Assignee: R82 A/S, Gedved (DK)

( * ) Notice: Subject to any disclaimer, the term of this patent is extended or adjusted under 35 U.S.C. 154(b) by 0 days.

(21) Appl. No.: 14/783,743

(22) PCT Filed: Apr. 9, 2014

(86) PCT No.: PCT/DK2014/050084
§ 371 (c)(1),
(2) Date: Oct. 9, 2015

(87) PCT Pub. No.: WO2014/166495
PCT Pub. Date: Oct. 16, 2014

(65) Prior Publication Data

US 2016/0296392 A1 Oct. 13, 2016

(30) Foreign Application Priority Data

Apr. 10, 2013 (DK) ..... 2013 70197

(51) Int. Cl.
*A61G 5/10* (2006.01)
*A47C 7/44* (2006.01)

(52) U.S. Cl.
CPC ..... *A61G 5/1067* (2013.01); *A47C 7/446* (2013.01); *A61G 5/10* (2013.01)

(58) Field of Classification Search
CPC ..... A61G 5/10; A61G 5/1067; A61G 5/1075; A61G 5/1081; A47C 7/44; A47C 7/441; A47C 7/443; A47C 7/446
See application file for complete search history.

(56) References Cited

U.S. PATENT DOCUMENTS 2,018,825 A 10/1935 Wood
4,004,836 A * 1/1977 Kristensson ..... A61G 5/12 297/301.2

(Continued)

FOREIGN PATENT DOCUMENTS

DE 3311376 A1 10/1984
WO 0069385 A1 11/2000
WO 2007042033 A1 4/2007

OTHER PUBLICATIONS

International Search Report for International Application No. PCT/DK2014/050084 dated Jul. 9, 2014.

(Continued)

*Primary Examiner* — Philip F Gabler

(57) ABSTRACT

An exemplary seat having seat connection mechanism for attaching the seat to a wheelchair includes a seat frame and a backrest. The backrest is pivotably connected to the seat frame through a pivoting mechanism. The seat further includes a biasing member connected to the backrest at a first connection point and a second connection point near the seat frame. The second connection point and the pivoting mechanism are spaced apart from one another by a distance C. The seat further includes an adjustment mechanism adapted for changing the distance C. The second connection point may be connected to a guide arm, such that the position of the second connection point is adjustable by sliding the second connection point along the guide arm, thus making the distance C adjustable.

15 Claims, 5 Drawing Sheets

(56) References Cited

U.S. PATENT DOCUMENTS

| | | | | |
|---|---|---|---|---|
| 4,761,033 | A * | 8/1988 | Lanuzzi | A47C 1/03255 297/300.3 |
| 5,328,237 | A * | 7/1994 | Yamaguchi | A47C 7/443 297/300.5 |
| 6,033,020 | A * | 3/2000 | Ito | A47C 1/026 297/302.4 |
| 6,488,332 | B1 | 12/2002 | Markwald | |
| 6,871,909 | B2 * | 3/2005 | Hobb | A47C 3/026 297/300.8 |
| 2004/0084950 | A1 | 5/2004 | Markwald | |
| 2005/0087968 | A1 | 4/2005 | Bennett | |

OTHER PUBLICATIONS

Danish Search Report for Denmark Application No. PA201370197 dated Sep. 19, 2013.

International Preliminary Report on Patentability dated Oct. 13, 2015, for International Application No. PCT/DK2014/050084.

* cited by examiner

SEAT

CROSS-REFERENCE TO RELATED APPLICATIONS

This application is the National Stage of International Patent Application No. PCT/DK2014/050084, filed Apr. 9, 2014, which claims priority to and all the advantages of Denmark Patent Application No. PA 2013 70197, filed on Apr. 10, 2013, the entire contents of which are hereby incorporated by reference.

TECHNICAL FIELD

The disclosure relates to seats for wheelchairs and a wheelchair with such a seat.

For the comfort of disabled persons in wheelchairs it is advantageous to equip the wheelchair with a seat having a dynamic reclinable backrest that is capable of absorbing the energy of sudden and forceful voluntary or involuntary movements of the person against the backrest.

The backrest shall also for therapeutic reasons be resilient such that users with a tendency to spasms, sudden uncontrolled movements etc. are not injured when using a wheelchair.

Such a movement will tend to extend the backrest towards a more reclined position. After the energy is absorbed the backrest should be capable of returning the person to an upright sitting position.

Such an exemplary wheelchair seat is made available by the applicant with a product known as the X:PANDA product. The seat in the wheelchair can be equipped with a reclinable backrest having a gas spring operably positioned between the backrest and the seat for absorbing the energy of the previously described movements extending the backrest.

BACKGROUND OF THE DISCLOSURE

A seat/backrest construction incorporating a gas spring is known from U.S. Pat. No. 2,018,825. The gas spring is arranged in a fixed (but selectable) position, and serves to provide added comfort to a user.

In order to cater for persons of various weight and strength the gas spring is selected from a range of gas springs each with a fixed rating. In case of a disabled child who is still growing the gas spring may have to be replaced frequently during the life of the wheelchair, because the forces applied to the backrest increases as the weight and height of the child increase. Therefore a certain size of gas spring (a certain tension) will only be optimally suited for the seat for a limited period of time.

It would therefore be advantageous to provide a seat for a wheelchair that is suited for disabled children who are still growing.

SUMMARY OF THE DISCLOSURE

One non-limiting example of a seat having seat connection mechanism for attachment of the seat to a wheelchair comprises a seat frame and a backrest. The backrest is pivotably connected to the seat frame through a pivoting mechanism and a biasing member connected to the backrest at a first connection point and to a second connection point near the seat frame. The second connection point and the pivoting mechanism are spaced by the distance C and the seat comprises adjustment means (113) adapted for changing the distance C.

Thereby the tension of the biasing member can be easily adjusted and the seat can thereby be adapted to different weight and strength, thus eliminating the need to replace the biasing member with a biasing member having a tension corresponding with an individual occupying the seat.

As another non-limiting example, the adjustment mechanism can be adapted for changing the distance C by displacement of the position of said second connection point position. Thereby an adjustment mechanism can be added to one connection point, making the adjustment mechanism simple to implement and handle.

In another non-limiting example, the second connection point can be connected to a guide arm and the position of said second connection point, and thereby the distance C, is adjustable by sliding said connection point along said guide arm. The guide ensures that the second connection point is fixed in all other directions than the relevant adjustment direction during adjustment, whereby the adjustment is easier to handle.

In still another non-limiting example, the guide arm can be mounted to the seat frame and said second connection point is slidably connected around said guide arm for sliding along said guide arm. This has proven to be a very simple and effective solution.

As yet another non-limiting example, the guide arm can be extending in a direction substantially perpendicular to the direction of the biasing member, thus facilitating with adjusting the tension of the biasing member.

As a further non-limiting example, the seat can comprise a biasing member connected to the backrest and the seat frame and positioned at each side of the seat. Thereby the spring means can absorb energy of movement of backrest evenly along the backrest surface.

In another non-limiting example, the seat can comprise a visual indicator for indicating actual distance C between said connection points. Thereby specific settings can be used as references, e.g. when setting according to a previous setting or when setting each side with a similar tension.

As still another non-limiting example, the seat can comprise a locking mechanism for locking the distance C and thereby the second connection point at predefined positions. Thereby it can be ensured that exact same positions are chosen each time when adjusting.

The non-limiting exemplary method of adjusting the resiliency of a backrest of a seat for a wheelchair, where said seat has seat connection means for attachment of the seat to a wheelchair includes:

- a seat frame (101),
- a backrest (103), wherein the backrest is pivotably connected to the seat frame through a pivoting mechanism (105), and
- a spring mechanism (107,207) connected to the backrest at a first connection point (109) and to a second connection point (111) near the seat frame, wherein the second connection point (111) and the pivoting mechanism (105) can be spaced a distance C, where the seat comprises adjustment mechanism (113) adapted for changing the distance C wherein said second connection point (111,211) is connected to a guide arm (115, 215) and the position of said second connection point (111,211) and thereby the distance C is adjustable by sliding said second connection point (111,211) along said guide arm (115,215) such that the greater the distance C the softer the resulting spring action will be, and the shorter the distance C the firmer the resulting spring action will be.

The resiliency is the ability of the back rest to be moved by the user during a sudden movement. The biasing member will dampen this movement. By being able to adjust the attachment point on the guide arm, the basic "force multiplied by the distance equals the resulting force" is utilised in order to adjust the most desirable resiliency (i.e. resilient counterforce) desired for a given user. The adjustment possibility facilitates the adjustment of this force as the need for more or less force is required/desired.

By further providing the spring mechanism as a double acting gas spring member, where said gas spring may be exchanged for another gas spring member having a different spring characteristic, a much wider range of users may be suitable for using the seat/wheelchair, simply by selecting an appropriate gas spring.

A wheelchair can comprise the non-limiting exemplary seat according to the above and with advantages as described above.

BRIEF DESCRIPTION OF THE DRAWING

Referring now to the drawings, exemplary illustrations are shown in detail. Exemplary illustrations are described in detail by referring to the drawings as follows.

DETAILED DESCRIPTION OF THE DRAWINGS

Figure 1A:
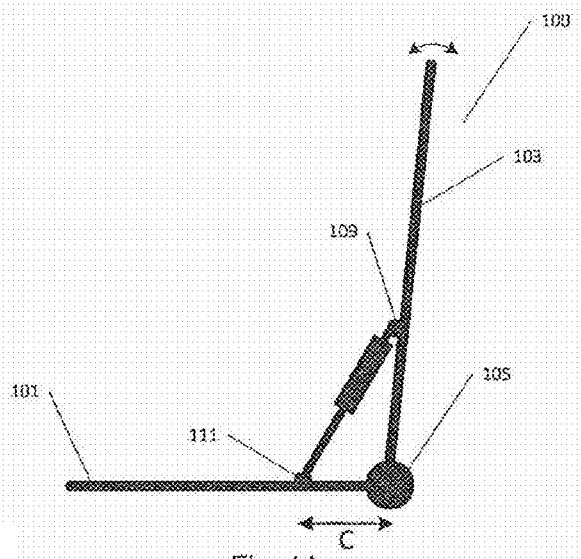
FIGS. 1A-1D illustrate one non-limiting example of a seat having a seatback and a seat frame, with the seat being adjustable for supporting a wide range of users having different weights and sizes.

In the explanation of the figures, identical or corresponding elements will be provided with the same designations in different figures. Therefore, no explanation of all details will be given in connection with each single figure/embodiment.

FIGS. 1A-1D illustrate a seat 100 for attachment to a wheel chair. The seat comprises a seat frame 101 and a backrest 103, which is pivotably connected to the seat frame through pivoting mechanism 105. The seat further comprises a biasing member 107 connected to the backrest 103 and the seat frame 101 through a first connection point 109 and a second connection point 111 near the seat frame 101, wherein the second connection point 111 and the pivoting mechanism 105 are spaced by the distance C. In one non-limiting example, the biasing member 107 can be a gas spring, but alternative spring elements could also be used.

The seat comprises an adjustment mechanism 113 for varying the distance C between the second connection point 111 and the pivoting mechanism 105.

Figure 1B:
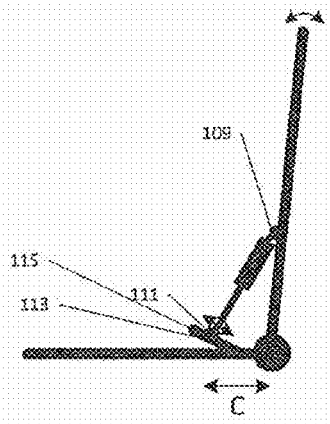
Figure 1C:
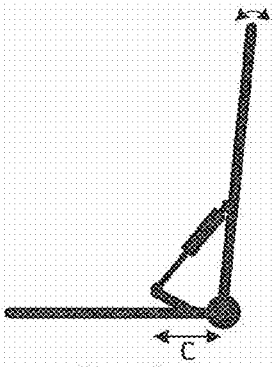
Figure 1D:
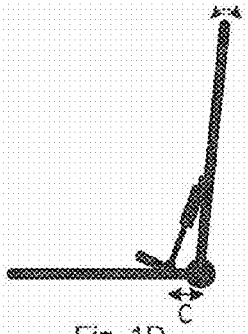

Referring to FIG. 1B, the distance C can be varied by displacement of the second connection point 111. In this example, the second connection point 111 is connected to a guide arm 115. Thereby adjustment mechanism 113 makes the connection point displaceable, whereby the distance C between the second connection point 111 and the pivoting mechanism 105 is adjustable by sliding the second connection 111 point along the guide arm 115. Referring to FIGS. 1C and 1D, the second connection point 111 is in two different positions, whereby the distance C is varied.

By moving the connection point in a different direction than the direction of the spring force it becomes easier to fine tune the distance, since it is not necessary to work against the forces of the biasing member. Further by having a guide arm where the connection points are moved along it is easier to control the process, since the guide arm assists.

Figure 2:
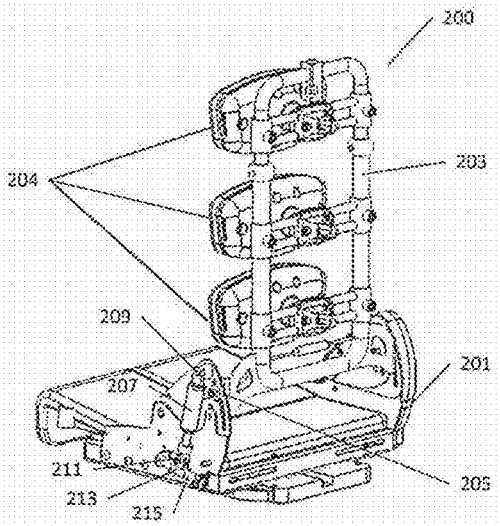
FIG. 2 illustrates a perspective view of the seat of FIGS. 1A-1D, as seen from behind the backrest, and being in a first angular position relative to the seat frame.

FIG. 2 illustrates the exemplary seat 200, as seen from behind the backrest 203, being in a first angular position relative to the seat frame. In this example, the seat 200 comprises a seat frame 201 with a support surface as well as the backrest 203 which comprises a number of back support elements 204. The back rest 203 and the seat frame 201 are pivotably connected in pivoting mechanism 205. The seat 200 further comprises a gas spring 207 connected to the backrest and the seat frame through a first connection point 209 and a second connection point 211.

The seat 200 comprises adjustment mechanism 213 for changing the distance between the second connection points 211 and the pivoting mechanism 205. The adjustment mechanism 213 comprises a guide arm 215 being mounted to the seat frame 201 and the second connection point 211 is slideably connected around said guide arm 215 for sliding along said guide arm in the direction of the guide arm.

Similar biasing member and adjustment mechanism are positioned at the opposite side of the seat.

Figure 3:
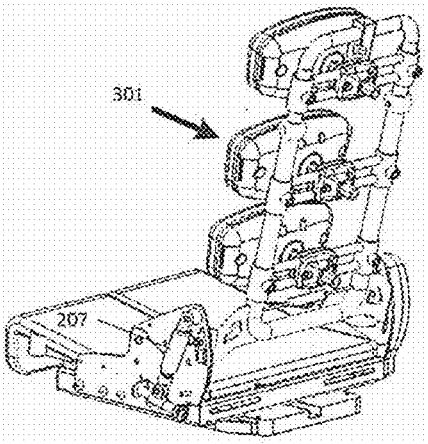
FIG. 3 illustrates a perspective view of the seat of FIGS. 1A-1D, as seen from behind the backrest being in a second angular position relative to the seat frame.

FIG. 3 illustrates seen from behind the backrest being in a second angular position relative to the seat frame, in this position the gas spring 207 is forced together because of load (indicated by arrow 301) on the backrest.

Figure 4:
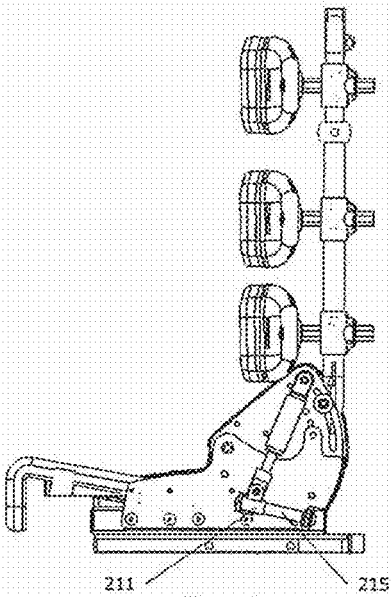
FIG. 4 illustrates a side elevation view of the seat of FIGS. 1A-1D, where the second connection point has a first distance C to the pivoting mechanism and where the backrest is in a first angular position relative to the seat frame.

FIG. 4 illustrates a side elevation view of the seat of FIGS. 1A-1D, where the second connection point 211 has been moved to one end of the guide arm 215, thereby a first distance between connection points is obtained and thereby one tension of the gas spring is obtained.

Figure 5:
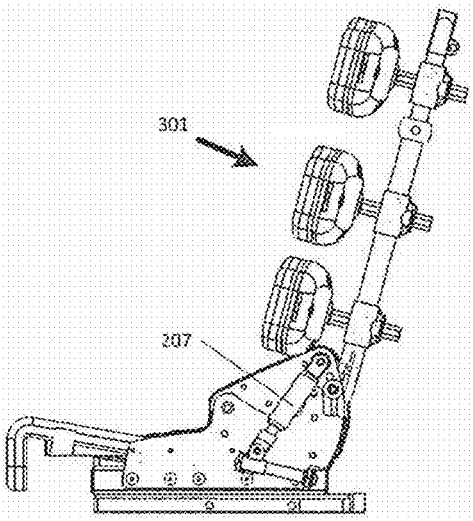
FIG. 5 illustrates a side elevation view of the seat of FIGS. 1A-1D, where the second connection point has a first distance C to the pivoting mechanism and where the backrest is in a second angular position relative to the seat frame.

FIG. 5 illustrates a side elevation view of the seat of FIGS. 1A-1D, where the backrest is in a second angular position relative to the seat frame, in this position the gas spring 207 is forced together because of load (indicated by arrow 301) on the backrest.

Figure 6:
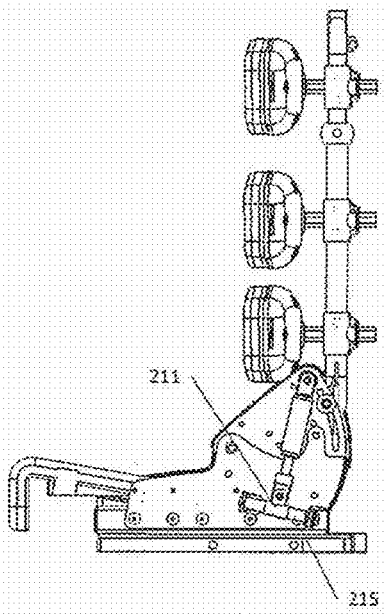
FIG. 6 illustrates a side elevation view of the seat of FIGS. 1A-1D, where the second connection point has a second distance C to the pivoting mechanism and where the backrest is in a first angular position relative to the seat frame.

FIG. 6 illustrates a side elevation view of the seat of FIGS. 1A-1D, where the second connection point 211 is positioned in the middle of the guide arm 215, thereby a second distance between connection points is obtained and thereby a second tension of the gas spring is obtained.

Figure 7:
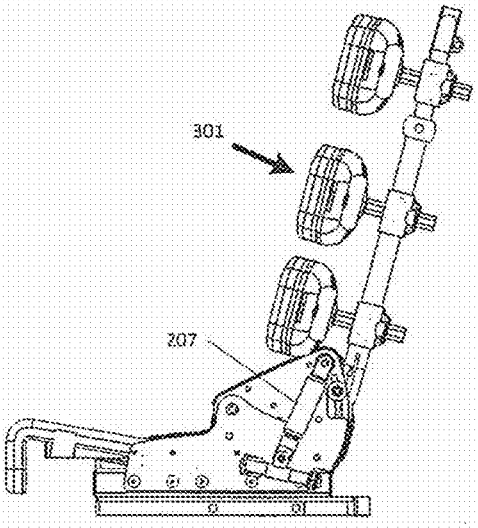
FIG. 7 illustrates a side elevation view of the seat of FIGS. 1A-1D, where the second connection point has a second distance C to the pivoting mechanism and where the backrest is in a second angular position relative to the seat frame.

FIG. 7 illustrates a side elevation view of the seat of FIGS. 1A-1D, where the backrest is in a second angular position relative to the seat frame, in this position the gas spring 207 is forced together because of load (indicated by arrow 301) on the backrest.

Figure 8:
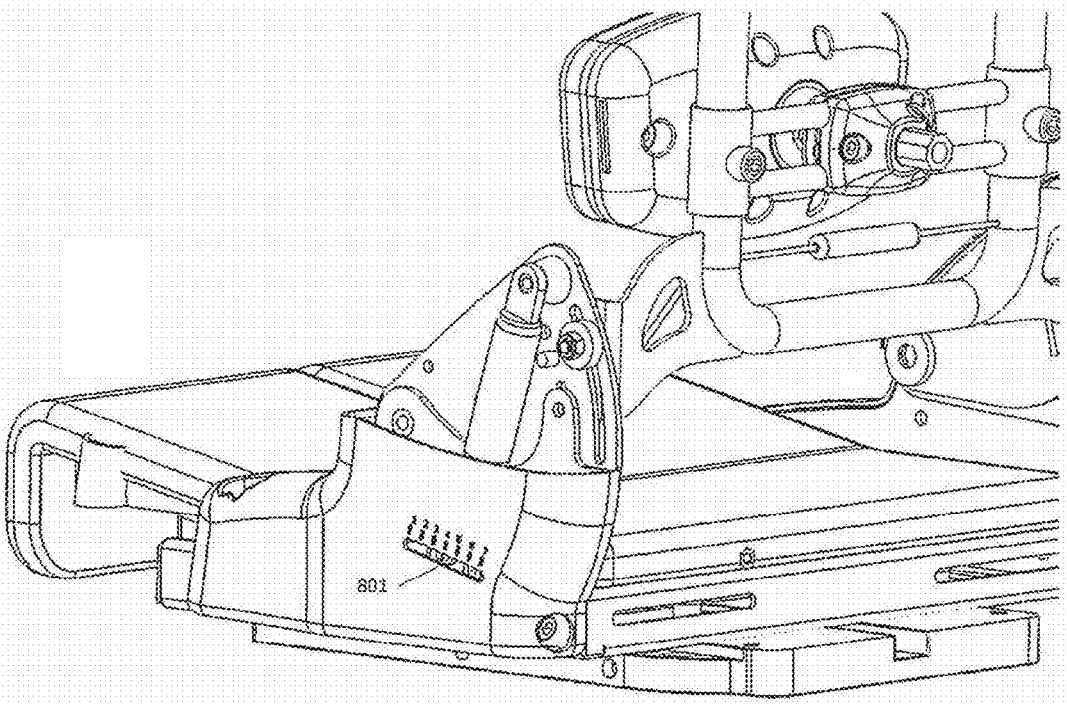
FIG. 8 illustrates an enlarged perspective view of the a portion of the seat of FIGS. 1A-1D, as seen from behind the backrest, and including the visual indicator for indicating actual distance C.

FIG. 8 illustrates an enlarged perspective view of the a portion of the seat of FIGS. 1A-1D, as seen from behind the backrest, and including the visual indicator 810 for indicating actual distance C between said connection points. Here a gap is made and the position of the connection point can be seen through the gap. Different positions indicate different tensions of the gas spring. Positions have been indicated by a visual scale, thereby positions can be referred to for later reference, e.g. for a similar position of a similar adjustment mechanism at the opposite side of the seat.

The invention claimed is:

1. A seat having a seat connection mechanism for attachment of the seat to a wheelchair, comprising:

a seat frame;

a backrest, wherein the backrest is pivotably connected to the seat frame through a pivoting mechanism; and a biasing member having a first end connected to the backrest and a second end positioned near the seat frame, wherein the second end of the biasing member and the pivoting mechanism are spaced by a distance C, wherein the seat comprises an adjustment mechanism adapted for changing the distance C, wherein the second end is slideably connected to a guide arm and the position of the second end and thereby the distance C is adjustable by sliding the second end along the guide arm, wherein the second end is continuously adjustable along the guide arm.

2. The seat according to claim 1, wherein the second end is slideably connected around the guide arm for sliding along the guide arm.

3. The seat according to claim 1, wherein the guide arm extends in a direction perpendicular to the direction of the biasing member.

4. The seat according to claim 1, wherein the biasing member is connected to the backrest and the seat frame and positioned at one side of the seat, and a second biasing member is connected to the backrest and the seat frame and positioned at an opposing side of the seat.

5. The seat according to claim 1, further comprising a visual indicator for indicating actual distance C.

6. The seat according to claim 1, further comprising a locking mechanism for locking the second end at predefined positions along the guide arm thereby fixing the distance C.

7. A wheelchair comprising a seat according to claim 1.

8. A seat having a seat connection mechanism for attachment of the seat to a wheelchair, comprising:

a seat frame;

a backrest, wherein the backrest is pivotably connected to the seat frame through a pivoting mechanism;

a biasing member having a first end connected to the backrest and a second end positioned near the seat frame, wherein the second end and the pivoting mechanism are spaced by a distance C, wherein the seat comprises an adjustment mechanism adapted for changing the distance C, wherein the second end is slidably connected to a guide arm and the position of the second end and thereby the distance C is adjustable by sliding the second end along the guide arm such that the greater the distance C the firmer the resulting spring action will be, and the shorter the distance C the softer the resulting spring action will be, wherein the second end is continuously adjustable along the guide arm.

9. The seat according to claim 8, wherein the biasing member is a double acting gas spring member.

10. A seat, comprising:

a seat frame;

a backrest pivotably connected to the seat frame at a pivoting point;

an adjustment mechanism comprising a guide arm mounted to the seat frame; and a biasing member having a first end connected to the backrest and a second end slideably connected to the guide arm near the seat frame, such that the second end of the biasing member and the pivoting point are spaced from one another by a distance C;

wherein the second end is continuously adjustable along the guide arm; and wherein the adjustment mechanism is adapted for adjusting a resulting spring action of the biasing member by sliding the second end of the biasing member along the guide arm to change the distance C between the second end and the pivoting point.

11. The seat according to claim 9, wherein the second end is slideably connected around the guide arm for sliding along the guide arm.

12. The seat according to claim 9, wherein the guide arm extends in a direction perpendicular to the direction of the biasing member.

13. The seat according to claim 10, wherein the biasing member is connected to the backrest and the seat frame and positioned at one side of the seat, and a second biasing member is connected to the backrest and the seat frame and positioned at an opposing side of the seat.

14. The seat according to claim 10, further comprising a visual indicator for indicating actual distance C.

15. The seat according to claim 10, further comprising a locking mechanism for locking the second end at predefined positions along the guide arm thereby fixing the distance C.

* * * * *